US008201836B2

(12) United States Patent
Holzer et al.

(10) Patent No.: US 8,201,836 B2
(45) Date of Patent: Jun. 19, 2012

(54) TOE BINDING OF A SAFETY SKI BINDING

(75) Inventors: Helmut Holzer, St. Johann (AT); Erich Rieger, Graz (AT)

(73) Assignee: Atomic Austria GmbH (AT)

( * ) Notice: Subject to any disclaimer, the term of this patent is extended or adjusted under 35 U.S.C. 154(b) by 497 days.

(21) Appl. No.: 12/394,414

(22) Filed: Feb. 27, 2009

(65) Prior Publication Data

US 2009/0283988 A1 Nov. 19, 2009

(30) Foreign Application Priority Data

Feb. 29, 2008 (AT) ..... A 333/2008

(51) Int. Cl.
*B62B 9/04* (2006.01)

(52) U.S. Cl. ..... 280/14.22; 280/617

(58) Field of Classification Search ..... 280/607, 280/617, 633, 636, 618, 608, 634, 616, 613, 280/615, 625, 611, 630, 623, 14.21, 14.22
See application file for complete search history.

(56) References Cited

U.S. PATENT DOCUMENTS

| | | | | |
|---|---|---|---|---|
| 3,963,253 | A * | 6/1976 | Rieger | 280/616 |
| 4,095,821 | A | 6/1978 | Salomon | |
| 4,499,674 | A | 2/1985 | Olivieri | |
| 4,514,916 | A * | 5/1985 | Aarflot | 280/615 |
| 4,522,422 | A * | 6/1985 | Jaeger | 280/617 |
| 5,033,768 | A | 7/1991 | Stritzl | |
| 5,118,128 | A | 6/1992 | Piegay et al. | |
| 5,236,218 | A * | 8/1993 | Rohrmoser | 280/630 |
| 5,293,702 | A | 3/1994 | Miyoshi et al. | |
| 5,722,681 | A * | 3/1998 | Merino et al. | 280/634 |
| 5,997,026 | A * | 12/1999 | Klubitschko et al. | 280/607 |
| 6,454,291 | B1 * | 9/2002 | Hillairet et al. | 280/616 |
| 6,467,796 | B1 * | 10/2002 | Weltman et al. | 280/615 |
| 7,063,345 | B2 * | 6/2006 | Holzer | 280/611 |
| 7,431,323 | B2 * | 10/2008 | Holzer et al. | 280/625 |

FOREIGN PATENT DOCUMENTS

| | | |
|---|---|---|
| DE | 2007306 | 9/1971 |
| DE | 2627305 | 12/1976 |
| DE | 2802251 | 7/1979 |
| DE | 3225336 | 2/1983 |
| DE | 3605313 | 8/1987 |
| EP | 0337905 | 10/1989 |
| EP | 0389757 | 10/1990 |
| EP | 0620030 | 10/1994 |
| EP | 1316265 | 6/2003 |
| FR | 1466483 | 4/1967 |

* cited by examiner

*Primary Examiner* — Hau Phan
(74) *Attorney, Agent, or Firm* — Lerner, David, Littenberg, Krumholz & Mentlik, LLP

(57) ABSTRACT

A toe binding of a safety ski binding includes a housing for at least partly mounting at least one release spring determining the safety release values and at least one sole holder loaded by the force of the release spring. When an upper force threshold is exceeded the sole holder releases the front section of a boot secured by the binding at least in lateral direction relative to the boot longitudinal axis. An adjusting device is adapted for individually changing the lateral alignment between the sole holder and the housing transversely to the binding longitudinal axis of the binding and substantially parallel to the standing plane for a boot, so that an angle or a lateral deflection between the boot longitudinal axis of a boot inserted into the binding and the binding longitudinal axis of the safety ski binding can be changed and individually preadjusted within predefined adjusting limits.

19 Claims, 3 Drawing Sheets

TOE BINDING OF A SAFETY SKI BINDING

CROSS REFERENCE TO RELATED APPLICATION

The Applicants claim the priority of Austrian patent application no. A 333/2008 of Feb. 29, 2008, in accordance with 35 U.S.C. §119.

FIELD OF THE INVENTION

The invention relates to a toe binding of a safety ski binding, as a safety ski binding itself

BACKGROUND OF THE INVENTION

From the prior art toe bindings with a safety release or adjustable holding force limit for the front section of a ski shoe are known in many different embodiments. Toe bindings of this kind have retaining devices or safety release devices, which can be regulated with regard to the holding force or holding moment within a predefined adjustment range. Furthermore, said toe bindings consist of a ski-secure positionable housing or base element, on which a sole holder designed in one piece or multiple parts can be pivoted against the effect of force of the safety release device, in order to release the boot or the boot tip from the ski binding when the preset limit is exceeded. The sole holder is configured in plan view to be substantially V- or fork-shaped, whereby the two sole holder arms, which run relative to one another in a V- or fork shape, are used at least for the lateral support of the toe section of a boot. In this case either the one-piece, fork-shaped sole holder or each of the two sole holder arms running in a V-shape relative one another are pivotable against the effect of force of the retaining device, which usually comprises a release spring, about at least one vertically aligned axis. On exceeding a predefined limit value, in particular a release threshold, the boot is then released at least in lateral direction.

With such toe bindings it is known to make either the clear spacing or the spreading angle between the sole holder arms adjustable, in order in this way to adjust the one-piece or multiple part sole holder to the respective shoe width or sole width to be mounted. In this way it is possible to mount boot tips of varying widths with only one type of individually adjustable toe binding or sole holder. According to DE 20 07 306 A1 a sole width adjustment is performed in that the outer end sections of the two V-shaped sole holder arms are connected respectively in an articulated manner to a base part, which base part on exceeding the pre-adjusted holding moment can be rotated about a perpendicular axis and thus releases the boot from the ski. In particular, by changing the angular position of the outer end sections of the sole holder parts relative to the base part the clear distance between the sole holder arms can be adjusted.

According to DE 26 27 305 A1 the mounting width between the sole holder arms is adjusted to the respective sole width not by an angular adjustment between the sole holder arms, but by a parallel adjustment between the two sole holder arms. By means of parallel displacement similarly the clear spacing between the sole holder arms can be changed in order to fit the respective sole widths.

In the aforementioned embodiments thus either an angle between the sole holder arms can be adjusted as necessary or alternatively a parallel spacing can be changed by means of an adjusting device, in order to allow an adjustment to the respective sole width, for example an adjustment to the width of a children's sole or an adult sole.

Also DE 28 02 251 A1 proposes measures by means of which the mounting width of the sole holder can be adjusted to different sole widths. Said sole holder, which is designed to be rigid and in one piece, comprises two V-shaped sole holder arms, which mount sliding units for the shoe to reduce the frictional contact between the shoe and the sole holder arms as far as possible. Said sliding units are mounted to be either replaceable or adjustable relative to the sole holder arms, such that the shoe bearing points on the sliding units can adopt at least two different spacings from the middle longitudinal axis of the binding. Also in this way there is an adjustment of the clear spacing between the sole holder arms to the respective sole width. The proposed changes in position of the sliding units should thus ensure that the lever arm for side releases is kept constant as far as possible in relation to the pivot axis of the sole holder, in order in the case of sole width adjustments to prevent changes to the safety release values. In particular, by means of said sliding units that are adjustable independently of one another or can be shifted separately from one another on the sole holder arms it is achieved that the release behaviour of the binding remains unchanged regardless of the respectively used ski shoe. The disadvantage of these known embodiments is that the left sole holder arm is changed relative to the right sole holder arm, to make adjustments to shoe sizes. The risk of maladjustments, in particular uneven adjustments between the left and right binding is increased in this way. In particular, there is a risk that both sole holder parts can be adjusted unevenly so that the binding is only usable in certain circumstances. The independent adjustability between the left and right sole holder arms is, in addition to increased susceptibility to error, time-consuming and can only be performed primarily by experts, to avoid having disadvantageous effects on the safety release values of the safety ski binding.

According to EP 0 620 030 B1 the heel mechanism of a ski binding is configured so that the natural foot position, i.e. the anatomical V-position of the feet, is maintained as far as possible when connecting the foot to a ski. This ensures an optimum edge grip and increases safety during skiing. The desired effects are achieved in that the heel hold-down device on the heel mechanism is connected off-centre to the binding unit, so that the middle axis of the heel hold-down device running in the direction of the ski longitudinal axis compared to the longitudinal axis of the binding unit maintains an angular deviation in lateral direction, whereby the heel of a ski shoe inserted in the ski binding is offset laterally in relation to the longitudinal axis of the binding unit. This off-centre position of the heel hold-down on the heel mechanism can also be adjusted variably according to one development and can be fixed as desired. Proposed technical solutions for the lateral relative adjustment between the heel hold-down and the heel mechanism are not described. The disadvantage of this is that it is structurally complex to change the lateral relative position between the heel hold-down and the housing of the heel mechanism. Furthermore, technical operations on the heel mechanism are relatively expensive and spontaneous or short-term changes of adjustments on the heel mechanisms for an end user of the ski binding are not possible. Rather only a factory production of heel mechanisms with varying lateral adjustments for the different foot positions or V-positions of the users is possible.

Independently of the configuration of ski binding components, designed already by the factory especially for use on the left or right foot, embodiments are known, in which directly on the sports shoe, especially on the ski boot, individual sole parts or sole extensions can be offset laterally, in order to obtain individual alignments of the boot longitudinal axis relative to the ski longitudinal axis. In particular, by means of the boot a so-called lateral offset or angular deviation can be achieved between the boot longitudinal axis and the ski longitudinal axis. Such configurations are described e.g. in DE 32 25 336 A1, U.S. Pat. No. 5,293,702 A or EP 1 316 265 B1 of the applicant. A disadvantage of this is that changes to the sole construction of the sports shoe are performed usually prior to practising sport, i.e. in preparation, and a short-term or spontaneous change in the alignment between the shoe sole and the shell parts of the shoe is virtually impossible in practice.

Furthermore, from DE 36 05 313 A1 a side-release safety ski binding for securing a ski boot tip is known. This comprises two side bindings laterally securing the ski boot and a release spring extending substantially in longitudinal direction of the ski, which is supported on the ski-secured binding housing and loads the side release mechanism with a force directed away from the ski boot, in particular to the front. The side bindings, the side release mechanism and the action point of the release spring on the side release mechanism are thus arranged on a support part that can be pivoted upwards in relation to the binding housing about a transverse axis. The transverse axis of this support part is a defined distance above the action line of the release spring, so that a predefined hold-down force originating from the release spring acts on the ski boot sole. Said ski binding allows both safety releases in lateral direction and safety releases in vertical direction, so that also so-called backwards rotational falls are taken into consideration or are at least cushioned. A functionally similar embodiment is described in EP 0 389 757 B1. Technical measures for the individual adjustment of the operating settings of these known toe bindings to various requirements of the user or varying user anatomies are not described in these documents.

SUMMARY OF THE INVENTION

The underlying objective of the present invention is to create a safety ski binding which allows the user to make a spontaneous change to the alignment of the sports shoe relative to a ski and which can still be produced reliably in terms of technical safety and in particular inexpensively. A further objective of the invention is to minimise the risk of maladjustments on said safety ski binding and also to allow inexpert and amateur users to make individual adjustments, without this having a damaging, negative effect on the safety settings of the safety ski binding.

The user of a ski binding, which is equipped with a toe binding designed according to an embodiment of the invention, is advantageously allowed in a simple manner, by changing the lateral relative position of the sole holder on the toe binding relative to the ski-secure positioned housing or relative to the load-removing support body of the toe binding, to adopt a connecting position or connecting orientation relative to the ski which corresponds to the natural position of the foot, in particular the anatomical V-position of the feet. In this way, on the one hand, for professional skiers or racers performance can be increased with the respective snow sliding device, in particular a ski, since the drive or curve performance, in particular the steering behaviour of the sliding unit can be adjusted particularly rapidly and simply individually by sports-persons and supervisors by adjusting the lateral binding offset. In particular, set-up tests can be performed particularly efficiently and rapidly with the toe bindings according to an embodiment of the invention. However, for amateur skiers advantageous effects can be achieved, in particular increased comfort, since the control and steering behaviour of the slide unit can be positively influenced or can be adapted more effectively to the respective wishes of the user. Also a ski binding designed according to an embodiment of the invention can be better adjusted in a simple manner to changing parameters of use or different ski disciplines, such as e.g. a main use for short, dynamic or drawn out, centrifugal force intensive movements. These increases in performance and comfort are partly achieved by ensuring a foot position that is as natural as possible, corresponding preferably to anatomical findings. Forming the adjusting device for the individual adjustment of the boot or foot orientation directly on the toe binding has the advantage that the respective settings can easily and clearly be checked by the user or supervisor or can be seen at any time. Furthermore, the design of the adjusting device on the toe binding has the advantage that its structure is not overly complicated and the volume of the structure is not increased or only minimally compared to a toe binding without this adjusting device. A particular advantage of the toe binding according to an embodiment of the invention is that its weight is not increased or is only slightly increased compared to a toe binding without said adjusting device. Furthermore, the number of parts required for a toe binding, which comprises the adjusting device according to an embodiment of the invention, compared to a typical toe binding without said adjusting device is not higher or only negligibly higher. Also the safety technical aspects of such a toe binding are not affected negatively by the adjusting device, which allows an individual shoe or boot alignment within predefined limits. Furthermore, the toe binding according to an embodiment of the invention, despite the increased functionality, can be produced particularly inexpensively. A further essential advantage of the toe binding according to an embodiment of the invention is that the risk of maladjustment is minimised, since the two sole holder arms of the V- or fork-shaped sole holder are displaced in lateral direction together or simultaneously and cannot be adjusted separately. This means that the original opening or mounting width of the V- or fork-shaped sole holder is not changed by changing the settings on the adjusting device. In this way disadvantageous effects on the safety adjustments of the safety binding are avoided. A further advantage is that if the user operates the adjusting device there are no or only marginal side effects on the preset release values, in particular the Z-values of the safety ski binding, if there is a change in the adjustment values on the adjusting device of the toe binding within the predefined adjusting limits. The relatively slight changes to the tensioning positions on the release mechanism usually lie within adjustment tolerances and changes to the tensioning positions between the toe binding, boot and heel mechanism of the safety ski binding are balanced as far as possible by the push spring usually provided in the heel mechanism of the safety ski binding. The toe binding according to an embodiment of the invention with lateral adjustability and individual adjustability of the boot orientation can thus also be operated by amateur or inexpert users as necessary or as desired, without causing safety critical changes in the safety release values. For security and safety technical reasons adjustments or changes to the safety release values of a safety ski binding can only be performed by specialist companies or by trained staff.

Another advantageous embodiment of the invention includes a multipart sole holder, which is also known as a pincer binding. The structure of such a known sole holder is inexpensive and functionally reliable. Furthermore, such a sole holder is ideal in connection with the adjusting device a toe binding that is as inexpensive as possible and structurally reliable with the lateral adjustability of the sole holder.

According to a further embodiment of the invention, an advantageous release behaviour can be achieved that is reliable in terms of technical safety.

Another embodiment of the invention is particularly advantageous, as in this way a toe binding can be created which provides either a backwards release or at least the damping of backwards falls or rear positions of the user. In particular, lifting movements of the boot tip can be damped initially by a toe binding constructed in this manner, in order thus to reduce peak loads for the movement apparatus of the user. This construction also allows a structurally relatively simple assembly of the components to achieve a damping of rear position damping or backwards release, a lateral safety release and adjustability of the orientation or lateral alignment of the boot relative to the binding or ski longitudinal axis. Such an embodiment is also relatively reliable in structural terms, inexpensive and particularly compact with respect to its structural volume.

Furthermore, the structural combination according to yet another embodiment of the invention is advantageous as in this way the pivot axis for the sole holder or its support element has a multiple function, whereby the structure of the toe binding can be made as compact as possible. In addition, by saving the need for numerous additional components for the adjusting device the weight of a toe binding designed in this way can be kept as low as possible.

Also by means of the measures according to a still further embodiment of the invention, a structurally compact toe binding with a relatively small number of components can be created. Said toe binding allows a change in the boot orientation, a lateral safety release and a damping of rear positions or a backwards release, i.e. a release of the boot when preset holding forces are exceeded. It is an advantage here that a functionally widened toe binding designed in this way can be made to be structurally reliable and cost-effective.

Another embodiment of the invention is also particularly advantageous, as because of the mulitfunctionality of the pivot axis additional components can be reduced. In this way low production costs are possible and the overall complexity of the toe binding can be reduced as far as possible.

Furthermore, a still further embodiment of the invention is advantageous as in this way the relative position of the adjusting spindle relative to the toe binding is not changed and only the support element together with the sole holder elements can be positioned variably in lateral direction relative to the housing. A particular advantage is that these adjustments can be carried out spontaneously by the user, i.e. if necessary at any time. In particular, no dismantling of the toe binding is required and no interference with the safety-relevant components of the toe binding is necessary to obtain a change in the boot alignment relative to the binding or ski longitudinal axis. By using a spindle arrangement, it is even possible to leave the boot in the safety ski binding and at the same time to make changes to the adjusting device.

In yet another embodiment of the invention it is an advantage, that if the threaded sections have a sufficiently low incline that a separate locking device is unnecessary. This means that the adjusting and setting operations can be performed particularly rapidly and the risk of incorrect operation is reduced. In particular, lack of attention by the user cannot result in critical operating states of the toe binding.

With the measures according to an embodiment of the invention, it is an advantage that the adjusting drive acts on the support element of the sole holder, so that the sole holder arms of the sole holder remain uninfluenced by elements for converting the adjusting drive.

In another embodiment of the invention, it is advantageous that by rotating the adjusting spindle a comfortable and reliable lateral adjustment of the sole holder can be achieved even under adverse conditions of use or environmental conditions.

By means of another configuration of the invention, the release spring can be designed in the form of a compression spring, whereby the tie rod can be used to obtain a reversal of the direction of force, so that the sole holder can exert the necessary, lateral holding forces on the boot tip.

By means of the measure yet another embodiment of the invention, it is ensured that the required adjusting area on the adjusting device, which is overall about 5 mm or in special cases can be up to 10 mm, without a deformation of components being provided. Furthermore, in this way side tilts or jamming of the safety release mechanisms of the toe binding are avoided.

With the measures according to a still further embodiment of the invention, it is advantageous that said angle levers can be designed to be relatively filigree-like starting from the tie rod by placing the tie rod on the angle levers or by gripping behind the angle levers and yet are still sufficiently stable. In particular, there is no need for openings or bolt-like connections between the tie rod and sole holder.

In addition, another embodiment of the invention is advantageous, as in this way the tie rod in its alignment remains unchanged or can remain unchanged as far as possible, if on the adjusting device the maximum or minimum adjustment value has been selected. In particular, lateral relative adjustments between the tie rod or between its coupling means and the sole holder are allowed. Since the tie rod can remain continually unchanged in its alignment or orientation, there are no or only marginal changes in the preadjusted tensioning values of the release spring. Safety critical changes in the safety release values are thus avoided in a simple manner.

BRIEF DESCRIPTION OF THE DRAWINGS

For a better understanding of the invention the latter is explained in more detail with reference to the following figures. In a schematic, much simplified representation.

DETAILED DESCRIPTION

Figure 1:
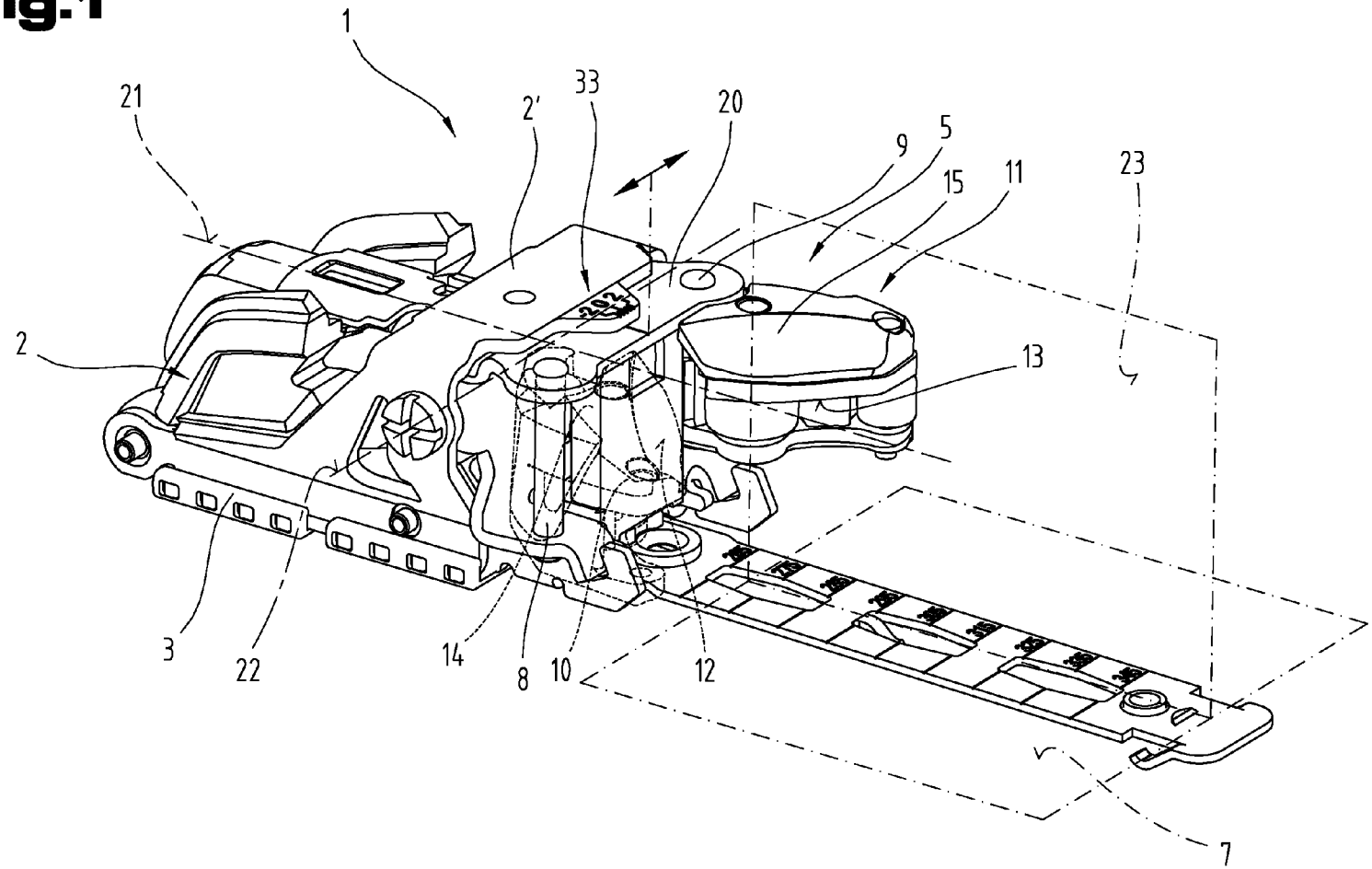
FIG. 1 shows a toe binding designed according to the invention of a safety ski binding in a partly assembled state in perspective view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

Figure 2:
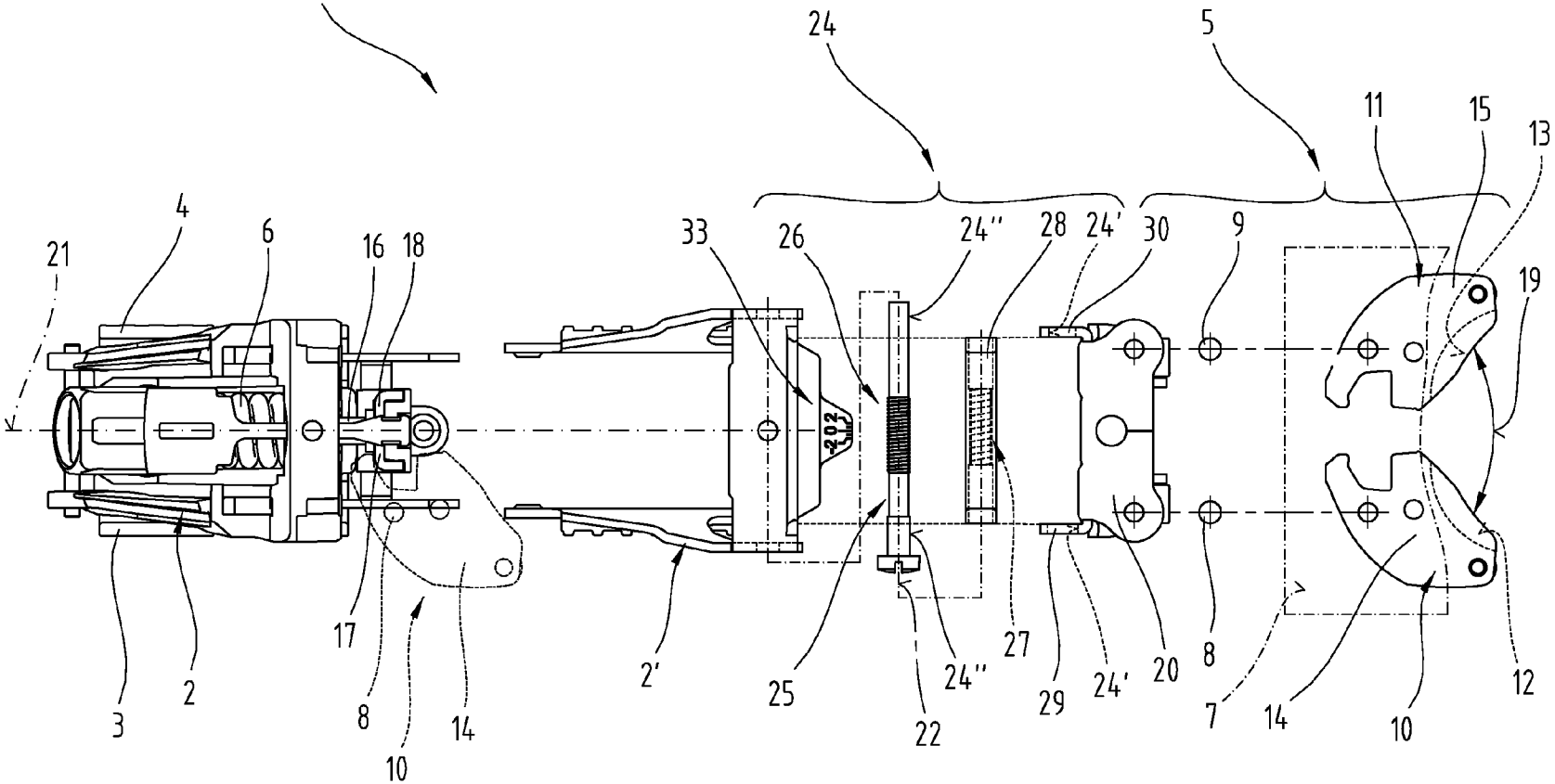
FIG. 2 shows the toe binding according to FIG. 1 in schematic explosive view.

In FIGS. 1, 2 an advantageous embodiment of a toe binding 1 of a safety ski binding according to the invention is shown.

As already known, said toe binding 1 shows the toe binding body of a safety ski binding provided for practising alpine skiing. A toe binding 1 of this kind forms in combination with a not shown heel binding or heel mechanism the safety ski binding, which releases a sports shoe, in particular a not shown ski boot, when a safety-relevant release threshold is exceeded, in order to prevent overstressing or injuries to the user as far as possible. Covering or lining elements for the toe binding 1 have been omitted for greater clarity.

Said toe binding 1 is usually assigned to the boot tip and with respect to its longitudinal position relative to a ski is often secured to be individually adjustable in a guiding rail running in the longitudinal direction of the ski, in order in this way to accommodate different shoe sizes. If necessary, there can also be a so-called free sliding securing of the toe binding 1 in this not shown guiding rail, in order to influence as little as possible the bending rigidity characteristic of the ski caused by the ski binding mounted on its top side and the boot inserted therein. In any case any longitudinal positioning and securing systems for the toe binding 1 known from the prior art, such as e.g. strap holders starting from a central fixed point or the like, can be implemented.

The toe binding 1 comprises at least one strength-relevant support body or a housing 2, which for example by means of lateral guide flanges 3, 4 is guided in a not shown guiding rail in longitudinal direction to the ski and with respect to its position is secured individually adjustably to the ski in relation to the longitudinal direction.

On said housing 2 or on a support body 2' diverting or receiving the forces, which extends at least in sections about the housing 2, at least one sole holder 5 is mounted which is provided for the moment-delimited securing of the toe section of a boot. The force threshold values or the holding forces of said sole holder 5 are determined by at least one release spring 6, which is mounted in the housing 2 or is surrounded at least partly by the housing 2. According to the exemplary embodiment shown the lateral release boundary forces or the lateral holding forces for the at least one sole holder 5 is determined by an individually adjustable pretensioning of the release spring 6. This corresponds to the so-called Z-values, i.e. the safety release values of the toe binding 1. Alternatively, it is also possible to provide a serial or parallel arrangement of individual springs, or it is also possible to design elastomer spring elements or hydraulic energy storage devices instead of spiral spring arrangements.

The sole holder 5 which is preferably designed to be clamp-like or made from multiple elements or rigid or built in one piece is pivotable on exceeding the preset holding or release force about at least one axis 8, 9 running substantially perpendicular to a standing plane 7 for a boot. In this way a lateral safety release of the boot tip mounted by the sole holder 5 with a specific holding force is achieved.

According to an advantageous embodiment the sole holder 5 comprises two sole holder elements 10, 11, which lie on lateral sections of the boot tip and thus secure the boot tip at least in lateral direction, i.e. perpendicular to the ski longitudinal axis or perpendicular to the binding longitudinal axis. Furthermore, a separately designed, either rigid or elastically flexible sole hold-down can be provided, which prevents the boot tip from lifting in an unwanted manner perpendicular to a standing plane 7 for a boot. Preferably however, at least one of the two sole holder elements 10, 11 is also designed as a sole hold-down 13, 14, in that at least one of the sole holding elements 10, 11 partially grips over or overlaps the boot tip and virtually covers the boot tip or a sole extension in a view from above, as indicated schematically in FIG. 3.

Preferably, the sole holder elements 10, 11 are formed by two angle levers 14, 15, the first lever arm of which represents the lateral sole holder elements 10, 11 and a sole hold-down 12, 13.

The two angle levers 14, 15 are arranged such that in plan view they form a V- or fork-shaped sole holder 5. Each of these angle levers 14, 15 is pivotable respectively about an axis 8, 9 aligned vertically to the standing plane 7, whereby the lever arms facing away from one another are provided for bearing on the boot tip and the facing or adjacent lever arms of the two angle levers 14, 15 are loaded directly or indirectly by the effect of force of the release spring 6.

Preferably, a tie rod 16 loaded by the preadjustable force of the release spring 6 is formed. Said tie rod 16 passes through the release spring 6 designed as a helical or compression spring. The end of the tie rod 16 closest to the boot tip preferably grips behind the closest adjacent lever arms of the angle levers 14, 15, as best shown in FIG. 2. The tie rod 16 is thus designed to be substantially T-shaped in plan view, whereby lateral webs 17, 18 of the tie rod 16 grip behind the closest adjacent lever arms of the sole holder elements 10, 11. In this way the sole holder elements 10, 11 or the corresponding angle levers 14, 15 are forced into a position of rest or a holding position, in which the securing of the boot tip is as play-free as possible. By adopting this position of rest or holding position the sole holder elements 10, 11 enclose a stop-limited minimum-spreading angle 19 in relation to one another.

Preferably, the two sole holder elements 10, 11 or the corresponding angle levers 14, 15 are mounted on a common support element 20. In particular, the angle levers 14, 15 are secured pivotably on a common support element 20. This means that the axes 8, 9 are formed on the support element 20 and that the support element 20 forms a connecting middle part for the sole holder elements 10, 11 pivotable about the axes 8, 9.

According to an advantageous embodiment said support element 20 can be pivoted about a pivot axis 22 running substantially parallel to the standing plane 7 and substantially perpendicular to the binding longitudinal axis 21. Such pivot movements, in particular the upwards pivot movements of the support element 20 are opposed by defined flexible elastic resistance, which is established by the release spring 6 and/or by a not shown retaining spring or by an elastomer pad.

The two sole holder elements 10, 11 form in connection with the support element 20 or in connection with its pivot axis 22 a kind of Cardan joint, which on the one hand allows lateral swivelling movements as well as an upwards pivoting movement of the boot tip, as soon as the respective holding forces are exceeded. The sole holder 5 formed in one piece or from multiple parts is thus mounted Cardanically in relation to the ski-secure positioned housing 2 or support body 2' of the toe binding 1. This means that the sole holder 5 is suspended over a kind of cross joint on the housing 2 or support body 2', once the axes 8, 9 of the sole holder elements 10, 11 have been rotated or offset relative to the pivot axis 22 of the support element 20 by 90°. Lateral swivelling movements and upwards pivoting movements of the sole holder elements 10, 11 in vertical direction away from the standing plane 7 are opposed by spring-elastic resistance, which can be preadjusted within certain limits at least by the release spring 6. Said safety release values are also known as so-called Z-values.

With regard to a vertical plane 23 running in the direction of the binding longitudinal axis 21 the pivot axis 22 is arranged above the tie rod 16 or above the effective axis of the release spring 6, so that an upwards pivoting movement of the support element 20 together with the sole holder elements 10, 11 mounted thereon is opposed by a resistance defined by the release spring 6. If necessary, mainly in the lower section of the housing 2 at least one additional spring can be formed, which opposes an upwards pivoting movement of the sole holder elements 10, 11 with a predetermined or preadjustable additional resistance.

The support element 20 is formed in cross section to be at least partly U-shaped, whereby its base section is supported on a resistance bearing surface of the housing 2 or support body 2'. In particular a pivot angle limitation is provided, which delimits the pivoting of the support element 20 downwards, i.e. in the direction of the standing plane 7.

Figure 3:
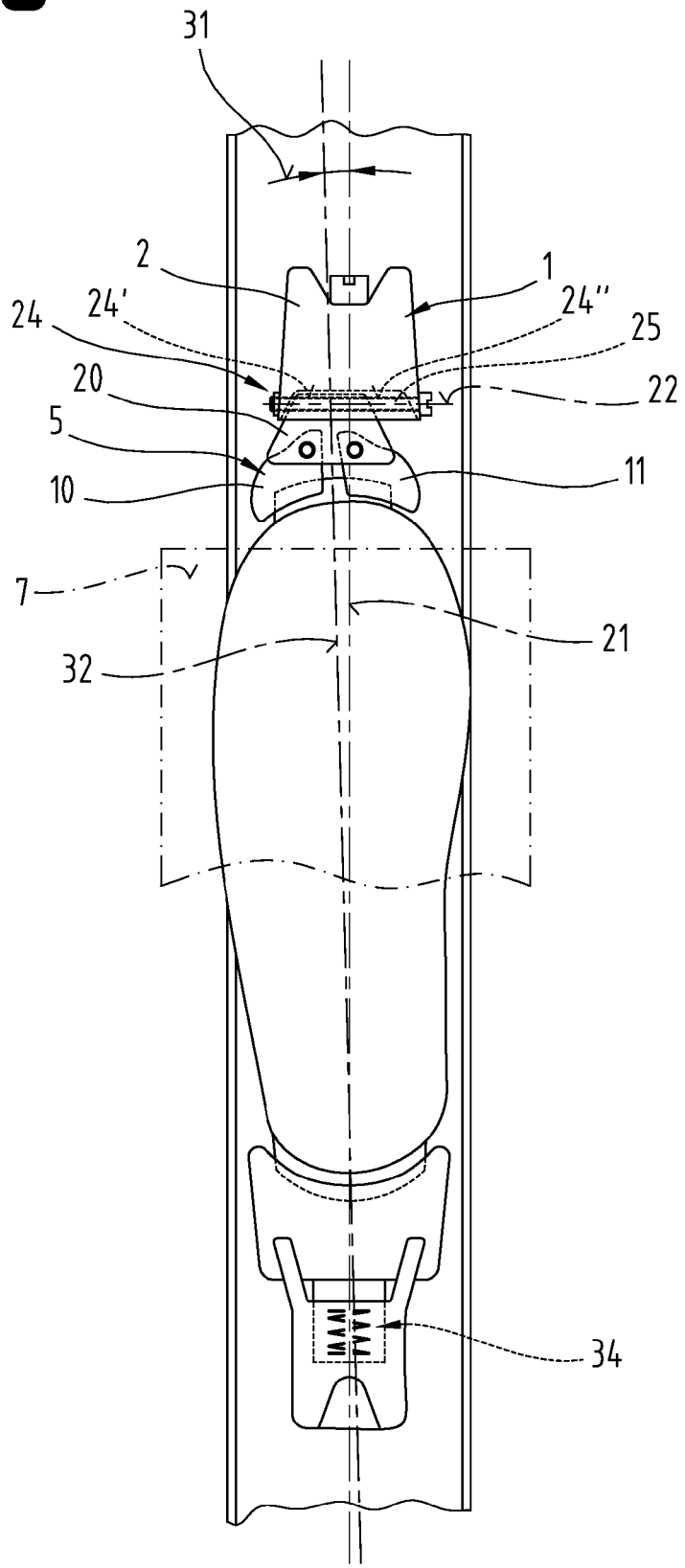
FIG. 3 shows a safety ski binding comprising a toe binding designed according to the invention and a heel mechanism in association with a ski boot and a board-like sliding unit, in particular a ski, in plan view.

It is essential that the toe binding 1 comprises an adjusting device 24, which is provided for individually preadjusting the lateral relative position between the sole holder 5 or between the sole holder elements 10, 11 and the housing 2 or its support body 2'. In particular, by means of the adjusting device 24 a change or adjustment of the relative position between the sole holder 5 and the housing 2 or support body 2' supporting the latter is possible substantially at right angles to the binding longitudinal axis 21 and substantially parallel to the standing plane 7. This means that the adjusting device 24 is designed such that between the sole holder 5 and the sole holder elements 10, 11 and the housing 2 or its support body 2' a transverse adjustment and securing to the respective desired position is made possible. The adjusting device 24 thus allows the adjustment and retaining or securing of a lateral offset between the sole holder 5 and the housing 2 relative to the binding longitudinal axis 21 or relative to the longitudinal middle axis of the toe binding 1. Thus an angle 31 or a lateral deflection between the longitudinal axis of a boot inserted into the safety ski binding and the binding longitudinal axis 21 or the ski longitudinal axis can be changed within predefined limits via the adjusting device 24, as best shown in FIG. 3.

By means of said adjusting device 24 on the toe binding 1 a more or less defined V-position or oblique position of the foot longitudinal axis relative to the ski longitudinal axis can be adjusted individually, whereby such adjustments are preferably performed by service staff or by the end user of the ski binding. By operating the adjusting device 24 it is possible to achieve a laterally offset mounting of the front ski section, that is adjustable to a limited degree in relation to the binding longitudinal axis 21 or in relation to the ski longitudinal axis. Said adjusting device 24 can be used at any time by the end user of the toe binding 1 or by service staff if there is a need to adjust the boot alignment relative to the ski longitudinal axis. Preferably, the adjusting device 24 is operated by means of an additional tool, such as for example a screwdriver or a coin. By forming a handle or a handle part on the adjusting device 24 a completely tool-free operation of the adjusting device 24 is possible.

It is particularly advantageous if in addition the support element 20 for the two sole holder elements 10, 11 is mounted axially adjustably on the pivot axis 22, about which the support element 20 can be pivoted up against spring force, i.e. can be spaced apart from the standing plane 7. In particular, a guiding device 24', 24" running in axial direction relative to the pivot axis 22 is formed between the support element 20 for the sole holder 5 and the pivot axis 22 for the support element 20, such that by means of the support element 20 and also by the one piece or multipart sole holder 5 in addition to a pivot or rotary movement about the pivot axis 22 also a translatory adjustability of the support element 20 or also the sole holder 5 is allowed in axial direction relative to the pivot axis 22.

It is advantageous, for the guiding device 24', 24" to be formed by pin or rod-like guiding elements and corresponding bores or openings, as shown by way of example in FIG. 2. These corresponding guiding elements of the guiding device 24', 24" thus allow a rotary adjustment of the sole holder 5 inside the vertical plane 23 and also a translatory relative adjustment between the sole holder 5, in particular between its support element 20 and the ski-secure mounted housing 2 or support body 2' of the toe binding 1 in lateral direction, i.e. in a direction perpendicular to the vertical plane 23.

It is preferable to design the substantially horizontal pivot axis 22 for the sole holder 5 as an adjusting spindle 25. With regard to the binding longitudinal axis 21 by means of a user-side rotation of the adjusting spindle 25 there is a lateral adjustment of the support element 20 together with the sole holder elements 10, 11 mounted thereon.

The adjusting spindle 25 is preferably fixed relative to the housing 2 or to the support body 2' in axial direction, whilst its rotary adjustability or rotatability is retained. The rotatability of the adjusting spindle 25 is obtained by suitable rotary bearing devices on the housing 2 or support body 2', in particular by bearing bores.

Thus the support element 20 in connection with the adjusting spindle 25 represents an embodiment of a travelling nut arrangement, by means of which the support element 20 can be moved bidirectionally in axial direction to the adjusting spindle 22, when the adjusting spindle 25 is moved in a corresponding rotary movement, i.e. rotated to the left or right. The adjusting spindle 25 preferably has a central or middle threaded section 26, which is in screw connection with corresponding threaded sections 27 on the support element 20. For example, this threaded section 27 is formed by a separate travelling nut 28, that is a spindle nut, which is connected in movement with the support element 20 or is held or mounted by the support element 20, so that the axial adjusting movement of the travelling nut 28 is transmitted to the support element 20 and then to the sole holder 5. If necessary, the threaded section 27 can also be cut directly into the support element 20, so that a separate component is unnecessary.

In the exemplary embodiment shown, the travelling nut 28 is secured between lateral holding tabs 29, 30 of the support element 20. The travelling nut 28 can also be designed as a sliding or guiding bush for the support element 20, to ensure the exact and as far as possible wobble-free and stable guiding of the support element 20 in axial direction relative to the adjusting spindle 25.

By means of the holding tabs 29, 30 the support element 20 is also pivotable on the adjusting spindle 24, in particular can be tilted about the pivot axis 22 and can be displaced at the same time to a limited degree in axial direction to the adjusting spindle 25. By means of the threaded sections 26, 27 that are mutually engaged with one another the preset relative position between the support element 20 and the adjusting spindle 25 or the housing 2 is ensured. It is essential that the holding tabs 29, 30 perform a rotary bearing relative to the adjusting spindle 25, whereby in the region of this pivot bearing or in the transition section from the adjusting spindle to the holding tabs 29, 30 no threads are formed and no threaded coupling is provided. The mutually threaded coupling between the support element 20 and the adjusting spindle 25 is preferably performed only in the central or middle section of the adjusting spindle 25. In the distal end sections of the adjusting spindle 25 preferably the combined translatory and rotary bearing or guiding device 24', 24" is formed for the sole holder 5 or for its support element 20. The adjusting drive for the sole holder 5 is obtained by the mutually corresponding threaded sections 26, 27 between the adjusting spindle 25 and the support element 20.

The adjustment range provided by the adjusting device 24 can be up to 5 mm, without seriously or negatively affecting the preadjusted safety release values of the toe binding 1. Preferably, on the left and right of the binding longitudinal axis 21 there is an adjustment range of about 2 mm for the user-initiated displacement of the sole holder 5. The adjustment range on the adjusting device 24 is thus about +/−2 mm with reference to the binding longitudinal axis 21. With reference to the binding longitudinal axis 21 or the ski longitudinal axis in this way an off-centre displacement of the front boot section is achieved influencing the driving or steering behaviour of the ski to a meaningful degree. In particular, in this way it is possible to achieve a change in angle of the boot longitudinal axis in relation to the ski or binding longitudinal axis 21 in an amount of several angle degrees.

With a lateral displacement of the sole holder 5 by means of the adjusting device 24 however there is only a relatively small lateral displacement or only a marginal change in the orientation of the tie rod 16 or the release spring 6 relative to the housing 2, so that the preadjusted release and holding values of the toe binding 1, in particular its Z-values, are either not changed at all or are changed by a negligible amount, i.e. are influenced within the usual adjusting tolerances. For safety and security reasons said release or Z-values of the safety ski binding are only adjusted by trained staff and are not changed afterwards by the user. It is essential that the spring force or the elastic pretensioning of the release spring 6, i.e. the safety technical Z-value of the toe binding 1 is hardly changed or is only marginally changed by means of a lateral displacement of the sole holder 5. Thus adjustments or user-initiated changes to the setting on the adjustment device 24 are not critical or are negligible with respect to the safety release values or Z-values of the toe binding 1. In particular, later adjustments to the safety release values of the toe binding 1 can be made unnecessary in connection with a user-initiated change to the setting on the adjusting device 24.

It is important that also transversely to the binding longitudinal axis 21 between the tie rod 16 and the housing 2 spatial free positions are provided, so that the tie rod 16 on activating the adjusting device 24 sideways to the binding longitudinal axis 21 is freely adjustable and together with the sole holder 5 can be displaced in lateral direction.

Alternatively or in combination therewith—as best shown in FIG. 2—the tie rod 16 or its webs 17, 18 grip behind the angle levers 14, 15 perpendicular to the binding longitudinal axis 21 with sufficient lateral play. This coupling of the tie rod to the angle levers 14, 15 is designed such that when operating the adjusting device 24 the tie rod 16 can remain substantially unchanged in its alignment relative to the binding longitudinal axis 21. Rather the angle levers 14, 15 can be slid substantially parallel to the standing plane 7 and perpendicular to the binding longitudinal axis 21 relative to the tie rod 16 or relative to its lateral webs 17, 18.

FIG. 3 shows the operation of the toe binding 1 according to the invention in connection with the principle structure of the safety ski binding in a schematic view. For the parts already described above the same reference numbers are used and the previous descriptions should be applied to the same parts with the same reference numerals.

If necessary the toe binding 1 of this ski binding shown in plan view can be held or secured on different positions in the longitudinal direction of the ski, in order to accommodate the respective boot sizes. In this case slide guides running in longitudinal direction to the ski and also known from the prior art and band-like holding elements can be provided between the binding bodies of the ski binding and the ski, so that in case of stronger bending of the ski strong distortions between the ski binding and the boot inserted therein can be avoided or such tendencies to distortion can be balanced out at least partly.

The position of the housing 2 of the toe binding 1 is secured unchanged transversely to the ski or sliding unit either by a screw connection or by the longitudinal guides. The lateral relative position of the housing 2 of the toe binding 1 remains continually unchanged in relation to the side edges of the ski or sliding device. Rather, the one piece or multipart sole holder 5 can be adjusted and secured individually by the adjusting device 24 substantially parallel to the standing plane 7 for a boot and substantially perpendicular to the binding longitudinal axis 21. This means that the sole holder 5 can be positioned off-centre or decentrally relative to the binding longitudinal axis 21. In particular, for a user of the ski binding if necessary a decentral positioning of the sole holder 5 can be adjusted or selected on the toe binding 1 in relation to the binding longitudinal axis 21. This adjustment movement is preferably a translatory relative adjustment between the housing 2 and the sole holder 5 transversely to the binding longitudinal axis 21. If necessary it is also possible to provide a curved sliding track, so that the sole holder 5 performs a curved adjustment movement and thus is moved about a defined central point of the curved track, which should be covered substantially by the extended shin axis.

It is clear from FIG. 3 that by means of the adjusting device 24 an angle 31 between a boot longitudinal axis 32 and a binding longitudinal axis 21, which is usually covered by the sliding board or ski longitudinal axis, can be adjusted or changed individually within predefined limits. This is achieved by the laterally adjustable and securable sole holder 5, whereby between the sole holder 5 and the housing 2 a transverse guiding track is formed. In particular, the sole holder 5 can be displaced by the guiding device 24', 24" and the adjusting device 24 transversely to the binding longitudinal axis 21. The adjusting device 24 acts in this case in axial direction to the substantially horizontal pivot axis 22 for the sole holder 5.

In relation to the binding longitudinal axis 21 by means of the adjusting device 24 for the sole holder 5 preferably a positive and also a negative angle 31 can be set. This means that the boot longitudinal axis 32 starting from a congruent position relative to the binding longitudinal axis 21 can be adjusted either to the left or right, that is closer towards the direction of the inner edge or closer to the direction of the outer edge of a ski. The respective adjustment setting of the adjusting device 24 can be read by the user of the ski binding on a scale 33, which is arranged for example on the housing 2 or on the support body 2', as indicated in FIG. 2.

The adjusting device 24 is preferably designed as a self-acting or automatically checking adjusting device. In particular, the adjusting drive of the adjusting device 24 is designed simultaneously as a locking or securing means. This is achieved in a simple manner by an adjusting spindle 25 with a sufficiently low thread pitch.

The bidirectional adjustability of the adjusting device 24 starting from a neutral position or central position of the sole holder 5 is advantageous in order to provide identical or structurally identical toe bindings 1, on the one hand, for an allocation to the left foot and, on the other hand, for an allocation to the right foot. In this way only one type or one single structural design of the toe binding 1 can be used optionally as a left and a right toe binding 1 of a ski binding to be used in a pair. This left or right allocation is made possible in a simple manner by using the left or right adjusting section of the adjusting device 24.

On the heel mechanism of the safety ski binding with a change of the settings on the adjusting device 24 preferably no changes or adjustments need to be made by the user. In particular, by means of a push spring 34 arranged in the heel mechanism, which forces a boot inserted into the ski binding with defined tensioning force in the direction of the toe binding 1, it is ensured that the boot inserted into the ski binding is then also mounted without play, if on the adjusting device 24 a maximum lateral displacement or a maximum eccentricity of the front sole holder 5 has been set relative to the binding longitudinal axis 21 or relative to the housing 2.

The schematically shown heel mechanism is also preferably provided with a safety release mechanism. The heel mechanism remains preferably, like the housing 2 of the toe binding 1, secured unchanged in transverse direction to the binding longitudinal axis 21 relative to the ski or sliding device. This means, that the position of the heel mechanism perpendicular to the binding longitudinal axis 21 and substantially parallel to the standing plane 7 cannot be changed. This transverse fastening applies similarly to the sole holder and the sole hold-down of the heel mechanism.

The exemplary embodiments show possible embodiment variants of the toe binding 1, whereby it should be noted at this point that the invention is not restricted to the embodiment variants shown in particular, but rather various different combinations of the individual embodiment variants are possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the toe binding 1 and the ski binding the latter and its components have not been represented true to scale in part and/or have been enlarged and/or reduced in size.

The underlying problem of the independent solutions according to the invention can be taken from the description.

Mainly the individual embodiments shown in FIGS. 1, 2; 3 form the subject matter of independent solutions according to the invention. The objectives and solutions according to the invention relating thereto can be taken from the detailed descriptions of these figures.

The invention claimed is:

1. A toe binding of a safety ski binding comprising:

at least one release spring having an adjustable pretensioning between at least a first pretensioning and a second pretensioning;

a housing for at least partly mounting the at least one release spring;

at least one sole holder having a predefined opening, the at least one sole holder adapted for releasably securing at least a front section of a boot inserted into the safety ski binding at least in a lateral direction to the longitudinal axis of the boot, the sole holder being loaded by the force of the release spring, which sole holder on exceeding predetermined release force threshold releases the front section of the boot by pivoting about at least one axis running substantially perpendicular to a standing plane of the boot, and an adjusting device operatively coupled to the housing and the at least one sole holder, the adjusting device being adapted for effecting individually preadjustable change in the lateral alignment between the sole holder and the housing in a transverse direction to the binding longitudinal axis of the safety ski binding and substantially parallel to the standing plane for the boot, so that an angle between the longitudinal axis of the boot and the binding longitudinal axis of the safety ski binding can be changed and individually preadjusted within predefined adjusting limits, wherein each pretensioning between the first and the second pretensioning of the release spring corresponds to one of a plurality of release values, wherein the force of the release spring on the at least one sole holder corresponds to the pretensioning of the release spring, wherein the predetermined release force threshold corresponds to one of the plurality of the release values, and wherein the adjusting device is configured such that the predefined opening of the sole holder remains unchanged after a user-initiated change to the lateral alignment of the sole holder relative to the housing.

2. The toe binding of claim 1, wherein the sole holder comprises first and second sole holder elements, each of the first and second sole holder elements comprising first and second angle levers, each of first and second angle levers comprising a first lever arm and a second lever arm, the first lever arms are adapted for lying laterally on the boot tip, and the second lever arms face one another and are loaded directly or indirectly by the spring effect of the release spring.

3. The toe binding of claim 2, wherein the first and second angle levers can be pivoted about axes running at least approximately perpendicular to the standing plane for a boot.

4. The toe binding of claim 3, wherein the axes are arranged on a common support element and said support element is pivotable about a pivot axis running perpendicular to the binding longitudinal axis and substantially parallel to the standing plane for the boot against the spring force in a direction removed from the standing surface.

5. The toe binding of claim 4, wherein the pivot axis comprises a rotational axis for the support element within a vertical plane running in the direction of the binding longitudinal axis, and an adjusting means, for adjusting the support element perpendicular to the vertical plane.

6. The toe binding of claim 1, wherein the sole holder is mounted on a support element, which can be pivoted against spring force about a pivot axis running substantially perpendicular to the binding longitudinal axis, and which support element can be positioned and individually preadjusted by the adjusting device in axial direction to said pivot axis relative to the housing of the toe binding.

7. The toe binding of claim 6, wherein the pivot axis for the support element is designed as an adjusting spindle.

8. The toe binding of claim 7, wherein the adjusting spindle is secured in an axial direction relative to the housing, and the support element can be variably positioned relative to the housing by rotation of the adjusting spindle in an axial direction to the adjusting spindle.

9. The toe binding of claim 7, wherein the adjusting spindle is movably connected via a threaded section with the support element.

10. The toe binding of claim 7, wherein the support element has a threaded section corresponding to the adjusting spindle or mounts a travelling nut.

11. The toe binding of claim 7, wherein the adjusting spindle runs substantially parallel to the standing plane for the boot and substantially at right angles to the binding longitudinal axis.

12. The toe binding of claim 1, further comprising a tie rod, wherein the release spring is designed as a compression spring adjustable in its pretensioning and acts by the tie rod on the sole holder.

13. The toe binding of claim 12, wherein spatial free positions are formed in transverse direction to the binding longitudinal axis between the tie rod and the housing so that the tie rod on activating the adjusting device can be adjusted unhindered sideways to the binding longitudinal axis and can be moved in lateral direction together with the sole holder.

14. The toe binding of claim 12, wherein one end of the tie rod facing the boot tip undergrips the facing first and second lever arms of the sole holder.

15. The toe binding of claim 14, wherein the tie rod grips under the first and second angle levers in a transverse direction to the binding longitudinal axis with sufficient lateral play, so that the first and second angle levers are adjustable in a sliding movement in a lateral direction to the binding longitudinal axis when operating the adjusting device relative to a tie rod substantially non-displaceable in its alignment relative to the binding longitudinal axis.

16. The toe binding of claim 1, wherein the sole holder comprises a V-shape.

17. The toe binding of claim 1, wherein the sole holder comprises an integral structure.

18. The toe binding of claim 1, wherein the sole holder comprises a multi-part structure.

19. A safety ski binding comprising:

a toe binding for securing the front section of a boot, a heel binding for securing the heel-side section of said boot; and at least one safety release mechanism with at least one release spring for delimiting the holding forces of at least the toe binding, wherein the toe binding comprises:

at least one release spring having an adjustable pretensioning between at least a first pretensioning and a second pretensioning;

a housing for at least partly mounting the at least one release spring;

at least one sole holder having a predefined opening, the at least one sole holder adapted for releasably securing at least a front section of a boot inserted into the safety ski binding at least in a lateral direction to the longitudinal axis of the boot, the sole holder being loaded by the force of the release spring, which sole holder on exceeding predetermined release force threshold releases the front section of the boot by pivoting about at least one axis running substantially perpendicular to a standing plane of the boot, and an adjusting device operatively coupled to the housing and the at least one sole holder, the adjusting device being adapted for effecting individually preadjustable change in the lateral alignment between the sole holder and the housing in a transverse direction to the binding longitudinal axis of the safety ski binding and substantially parallel to the standing plane for the boot, so that an angle between the longitudinal axis of the boot and the binding longitudinal axis of the safety ski binding can be changed and individually preadjusted within predefined adjusting limits, wherein each pretensioning between the first and the second pretensioning of the release spring corresponds to one of a plurality of release values, wherein the force of the release spring on the at least one sole holder corresponds to the pretensioning of the release spring, wherein the predetermined release force threshold corresponds to one of the plurality of the release values, and wherein the adjusting device is configured such that the predefined opening of the sole holder remains unchanged after a user-initiated change to the lateral alignment of the sole holder relative to the housing.

* * * * *